US009752418B2

(12) United States Patent
Meador et al.

(10) Patent No.: US 9,752,418 B2
(45) Date of Patent: Sep. 5, 2017

(54) SLIP WITH ALTERING LOAD DISTRIBUTION FEATURE

(71) Applicant: Baker Hughes Incorporated, Houston, TX (US)

(72) Inventors: Charles M. Meador, Cypress, TX (US); Matthew J. Krueger, Houston, TX (US); Christopher R. Hern, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 639 days.

(21) Appl. No.: 14/132,886

(22) Filed: Dec. 18, 2013

(65) Prior Publication Data

US 2014/0338892 A1 Nov. 20, 2014

Related U.S. Application Data

(63) Continuation-in-part of application No. 13/893,565, filed on May 14, 2013.

(51) Int. Cl.
*E21B 43/10* (2006.01)
*E21B 33/129* (2006.01)

(52) U.S. Cl.
CPC ..... *E21B 43/10* (2013.01); *E21B 33/1291* (2013.01)

(58) Field of Classification Search
CPC ..... E21B 43/108; E21B 23/01; E21B 43/10; E21B 33/1291
See application file for complete search history.

(56) References Cited

U.S. PATENT DOCUMENTS

| | | | | |
|---|---|---|---|---|
| 4,711,326 | A | 12/1987 | Baugh et al. | |
| 5,086,845 | A | 2/1992 | Baugh | |
| 6,431,277 | B1 | 8/2002 | Cox et al. | |
| 7,546,872 | B2 | 6/2009 | McGilvray et al. | |
| 2003/0164236 | A1* | 9/2003 | Thornton | E21B 17/1042 166/278 |
| 2006/0278404 | A1* | 12/2006 | Fay | E21B 43/10 166/382 |
| 2015/0090441 | A1* | 4/2015 | Lovslett | E21B 33/1293 166/216 |

* cited by examiner

*Primary Examiner* — David Andrews
*Assistant Examiner* — Kristyn Hall
(74) *Attorney, Agent, or Firm* — Steve Rosenblatt

(57) ABSTRACT

A liner hanger has slips held by a slip body. A potential energy force to move the slips axially when the hanger is in position is selectively released. The nature of the loading between the slips and the casing changes from a radial reaction force from the casing going into the slip and then distributed circumferentially to the slip housing to an essentially axial loading of the slip housing down onto the slip that has penetrated the casing with an opposite reaction force in the casing wall. The contact location between the slip housing and the slip is made broader at the slip end with a wider portion having an undercut to reduce contact stress and to aid in promoting flow past the set slip. The slip housing also has axial flow channels that interact with the undercut to promote flow past the set slips.

21 Claims, 3 Drawing Sheets

SLIP WITH ALTERING LOAD DISTRIBUTION FEATURE

CROSS REFERENCE TO RELATED APPLICATION

This application is a continuation-in-part of U.S. patent application Ser. No. 13/893,565, for "Slip with Altering Load Distribution Feature", filed on May 14, 2013, and claims the benefit of priority from the aforementioned application.

FIELD OF THE INVENTION

The field of the invention is slips that are radially actuated to support one string on another and more particularly where the loading on the surrounding tubular is changed from a mostly radial to a mostly axial orientation during the setting of the slips.

BACKGROUND OF THE INVENTION

Liners are frequently hung on casing using liner hangers. The liner hangers have slips for anchoring support for the liner string that are extended radially. The leading end of each slip has a serrated leading face that is designed to penetrate the surrounding casing wall for a grip. The slips are generally individual segments that are edge guided in a conforming recess in a slip body. The edge guiding is in effect an angled ramp so that as the slips move axially they also extend radially. The force to initiate the slip movement can be a potential energy force such as a spring force that is held during run in and then released to act on each slip to move the slip in an uphole direction along the supporting edge ramps. Following the extension of the slips the weight of the liner can be released from a running string for full support on the surrounding casing. A seal is usually associated with the liner hanger and is generally set after the liner is cemented.

When the slips contact the surrounding casing a radial reaction force ensues from the casing and into the extended slip. That radial force is then transmitted to the slip housing in a circumferential direction. This slip design is well known and is illustrated in U.S. Pat. No. 7,546,872 (FIG. 9); U.S. Pat. No. 6,431,277 (FIGS. 37 and 38); U.S. Pat. No. 5,086,845 (FIG. 3) and U.S. Pat. No. 4,711,326.

At some predetermined loading when the slips are extended into the surrounding casing and the weight of the liner is transferred to the slips the side walls of the slip housing that abut the slips on opposed ends to guide them axially and radially begin to yield indicating a limiting condition for the load that can be supported. The present invention addresses this limit and with a simple modification seeks to alter the nature of the loading between the casing and the liner string supported of it by the slips. In essence, the traditional force orientation of the known designs comprising a radial reaction force into each slip that then goes into the slip housing circumferentially is changed by having a portion of the slip body contact the top of the extended slip that has already been extended into engagement with the surrounding casing. What then happens is that the weight of the liner string is transferred predominantly axially from the slip body into the engaged slip in a substantially axial direction so that the reaction force from the casing is in an opposite axial direction. This reduces slip housing distortion at opposed sides of each slip and allows a greater support capacity for the slips without substantial engineering revision from the configuration of the existing designs making retrofits possible. The load capacity for a given size is greatly enhanced. In an improvement of this design the end of the slip has a broader dimension than the balance of the slip body to reduce contact stress and to allow the use of a thinner slip which in turn allows higher mandrel pressure rating to be used in a given surrounding tubular. The broadened lower end also features edge undercuts to promote fluid flow past the set slips and the slip housing is also formed with flow slots for enhancement of flow past the set slips. The load carrying capacity increase with the addition of the wings on the end is in the order of 50%. These and other aspects of the present invention will be more readily apparent to those skilled in the art by reviewing the description of the preferred embodiment and the associated drawings while recognizing that the full scope of the invention is to be determined from the appended claims.

SUMMARY OF THE INVENTION

A liner hanger has slips held by a slip body. A potential energy force to move the slips axially when the hanger is in position is selectively released. The slips move axially and radially outwardly guided on opposed edges by the slip body. The slip faces have wickers that dig into the surrounding casing that will support a liner string off the slips. Weight is set down to bring the housing into contact with the top of the slips that are already engaged to the surrounding casing. The nature of the loading between the slips and the casing changes from a radial reaction force from the casing going into the slip and then distributed circumferentially to the slip housing to an essentially axial loading of the slip housing down onto the slip that has penetrated the casing with an opposite reaction force in the casing wall. The contact location between the slip housing and the slip is made broader at the slip end with a wider portion having an undercut to reduce contact stress and to aid in promoting flow past the set slip. The slip housing also has axial flow channels that interact with the undercut to promote flow past the set slips.

DETAILED DESCRIPTION OF THE PREFERRED EMBODIMENT

Figure 1:
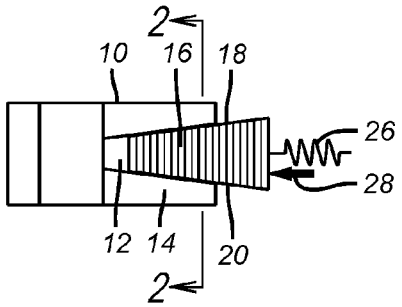
FIG. 1 is a plan view showing one slip and the associated slip housing that is a tubular shape in the run in condition.
Figure 2:
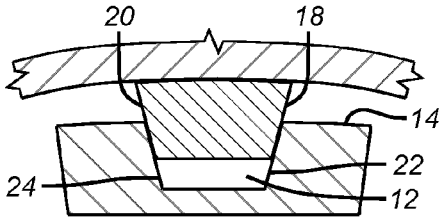
FIG. 2 is the view along line 2-2 of FIG. 1.

Referring to FIG. 1 the slip housing 10 is a tubular structure with a series of axial slots 12 in an outer surface 14.

Figure 3:
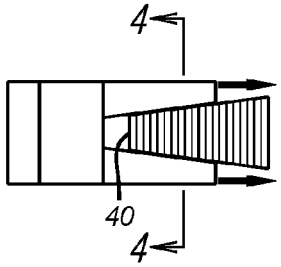
FIG. 3 is the view of FIG. 1 with the slips extended to the surrounding casing.
Figure 4:
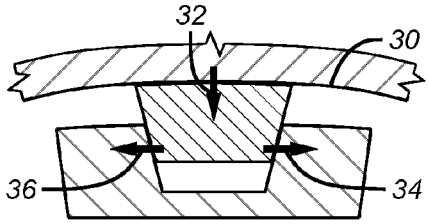
FIG. 4 is the view along line 4-4 of FIG. 3.
Figure 5:
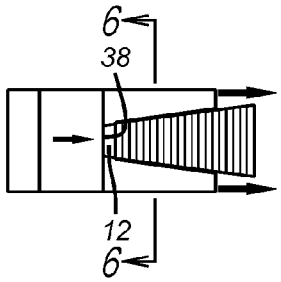
FIG. 5 is the view of FIG. 3 showing the onset of setting down weight and the side wall distortion that can occur.

Each slip 16 is in a respective slot 12. Each slip 16 has opposed tapered sides 18 and 20 that respectively abut guide surfaces 22 and 24 on slots 12. A potential energy source 26 is schematically illustrated with a selective lock represented by arrow 28. As the lock 28 is released at the desired subterranean location inside a surrounding existing tubular the potential energy source is released and the slips 16 advance axially in an uphole direction that is also indicated by arrow 28. Thus far the operation of the slip is the same as in the above described patents and continues to be that way including FIGS. 3 and 4 where the slips 16 have been moved sufficiently far axially to extend radially into contact with the casing 30. This results in a radial reaction force represented by arrow 32 which then is distributed circumferentially into the slip housing 10 as further represented by arrows 34 and 36.

Figure 6:
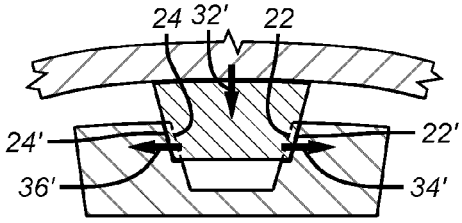
FIG. 6 is the view along line 6-6 of FIG. 5.

The present invention differs from the previous designs in the use of the end 38 of the slot 12 to engage the top 40 of the slips 16 when weight is slacked off from the surface to release the running string (not shown) that is supporting the slip housing 10 that is part of the liner hanger that is also not shown. In the past the act of slacking off weight on the slip housing 10 resulted in yielding of the opposed walls 22 and 24 shown in their original location in FIG. 6 in dashed lines to a yielded position shown as solid lines 22' and 24'. At this point there is no contact of the upper end 38 of the slot 12 by the top of the slips 16. Despite the yielding, the loading is as reflected in FIG. 6 with a radial reaction force from the casing 30 represented by arrow 32' that is then transferred circumferentially as represented by arrows 34' and 36'. This condition represented the state of the art before the present invention.

Figure 8:
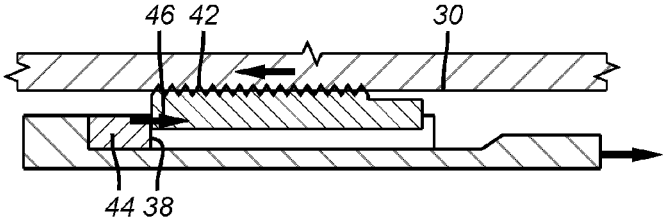
FIG. 8 is the view along line 8-8 of FIG. 7.

What happens in the present invention is that the setting down weight on the extended slips 16 brings the end of the slot 38 down on the top of the slips 16 that at that time are already penetrating the casing 30 with their wickers 42 as shown in FIG. 8. The end 38 of the slot can be the bottom of a ring or segments 44 or it can be integrated into the slip housing 10. Use of the ring is for ease of assembly of the components so it is preferred. What happens when the end 38 of the slot 12 lands on the slips 16 with wickers 42 embedded in casing 30 is that the bulk of the load transfer from the liner string that is not shown that is supported from the slip housing 10 is now axial going down into the slip 16 as represented by arrow 46 and then into a shear load on the embedded wickers 42 that penetrate the casing 30. There may still be some yielding denoted by surfaces 22' and 24' in FIG. 6 but the degree of the yielding will decrease if not go back to the original dimensions denoted by 22 and 24 because the radial component 32' decreases as the bulk of the load transfers from the slip housing 10 at 38 axially directly down onto the top 40 of the slips 16.

Due to the loading going from primarily radial and then circumferential as in the past to primarily axial s shown in FIG. 8 greater loading capacities can be achieved with a minimal modification in the design. Additional load carrying capacity in the order of 1,000,000 pounds for hangers that formerly had capacities of about 1,500,000 pounds with the known designs previously described is unexpectedly attained. While some radial reaction force from the casing can still remain its component of the reaction forces from the casing is highly attenuated as is any corresponding distortion of the edges of the slots for the slips.

Those skilled in the art will appreciate that the radial extension of the slips can vary to suit the anticipated internal dimension of the surrounding tubular. This can be addressed with the amount of axial travel the slip can undertake before engaging the ring or segments 44 or the end of the slot 38. By the same token the end of the slot or the dimension of the ring or segments can be made differently to accommodate the expected internal diameter of the surrounding tubular into which the slips are intended to bite. While the movement of the slips has been illustrated in the uphole direction, movement in the opposite or another direction are also contemplated when the slips are extended.

Figure 7:
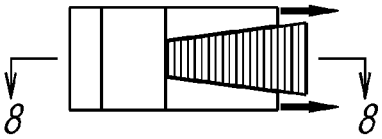
FIG. 7 is the view of FIG. 5 showing the end of the slot of the slip housing contacting the slip.
Figure 9:
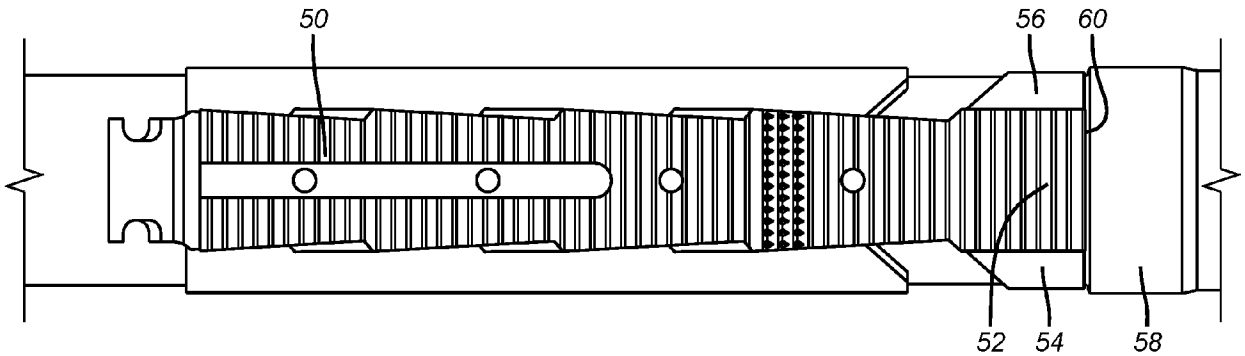
FIG. 9 is an alternative embodiment to FIG. 7 showing the enhanced contact area at the end of the slip.
Figure 10:
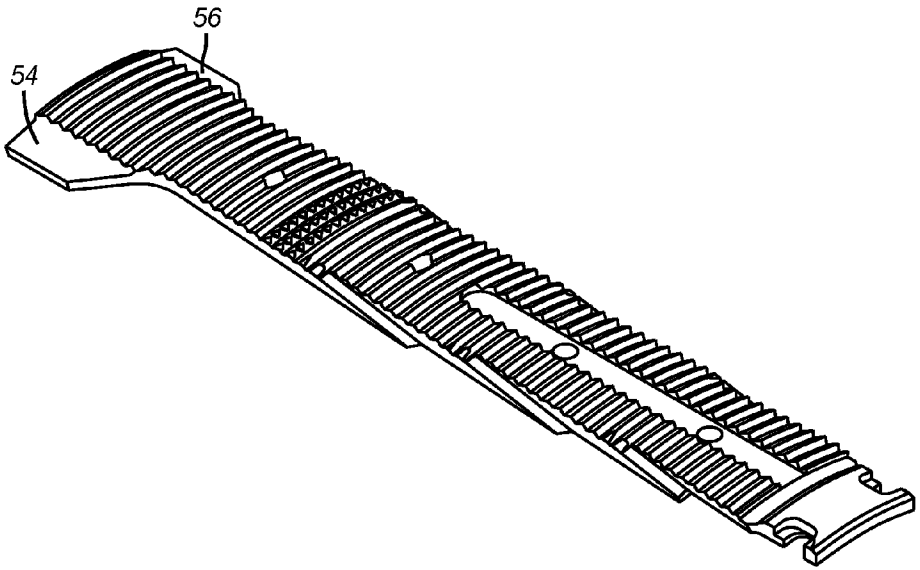
FIG. 10 is a perspective view of the slip showing the side guide ramps and the enhanced contact end to the slip housing and the undercuts for enhanced flow.

FIG. 9 is an alternative embodiment to FIG. 7 showing a slip 50 that differs from FIG. 7 by having a broader end 52 that features spaced undercuts 54 and 56 such that the contact area with the ring 58 is increased. This reduces the stress when surface 60 of lower end 54 contacts the ring 58 which is part of the slip housing. The slip thickness can be reduced for comparable loading as the FIG. 7 design and this allows a thicker mandrel wall to be used for a higher pressure rating. Alternatively, the capacity of the slips in the FIG. 9 design as compared to FIG. 7 shows an increase in testing of about 50% in load carrying capacity.

Figure 11:
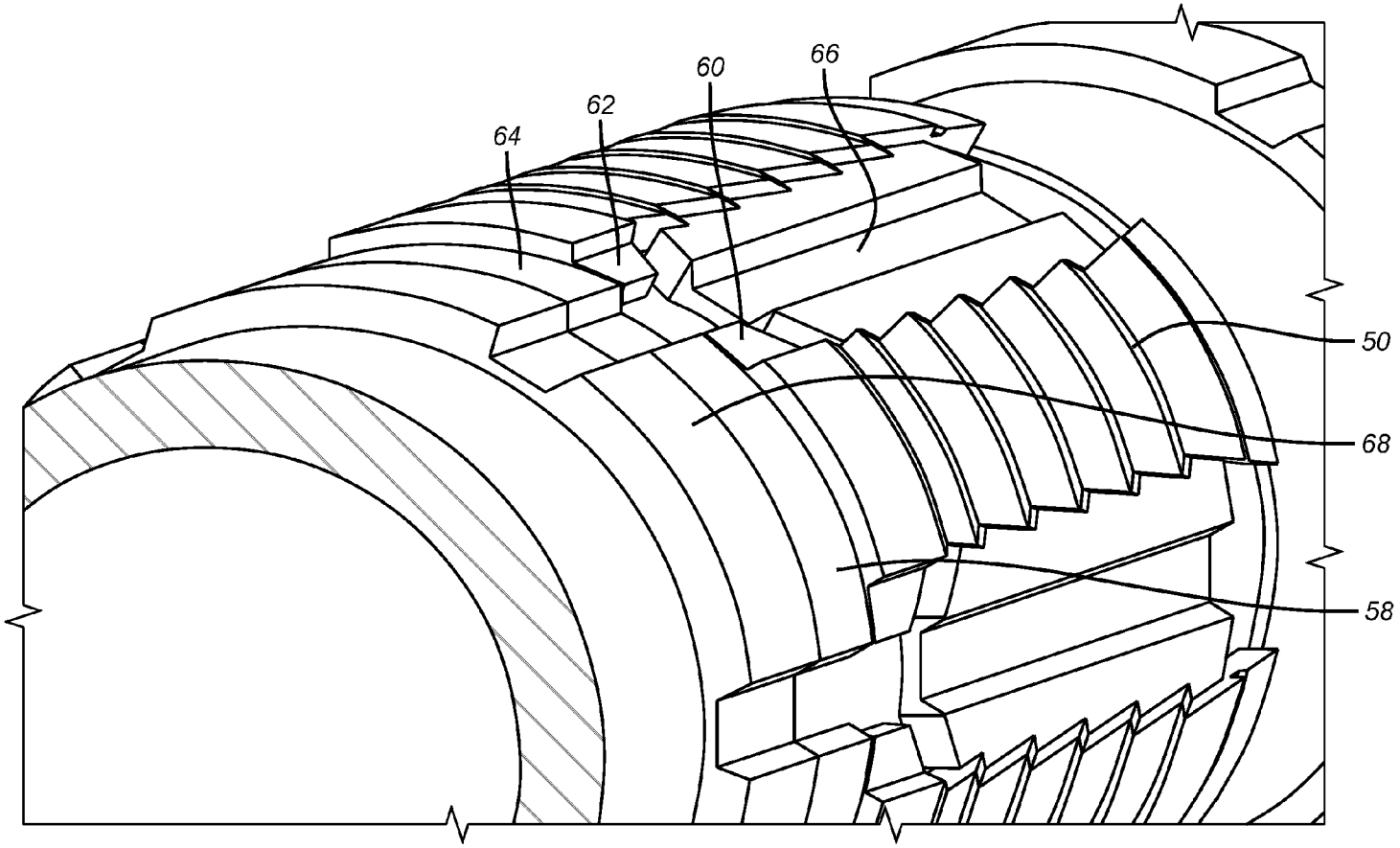
FIG. 11 is the view of FIG. 10 showing the assembly in perspective and in the set position for the slips.

FIG. 11 illustrates ring 58 that has an outer surface 64 that is preferably flush with undercut top surfaces 60 and 62. An elongated slot 66 extends past ring 58 and into an adjacent ring 68. Undercuts 54 and 56 promote channeling of moving fluid past the slips 50 as they have outer surfaces that are preferably flush with surface 64 to promote flow into slot 66 for enhanced flow past the slips 50.

Those skilled in the art will appreciate that having a broader end to the slips where they contact a support member such as 58 allows for either enhanced load carrying capacity of the slips or the ability to make the slips thinner while carrying the same load so that the pressure rating of the mandrel or other components can be increased by making the walls thicker. Adding the undercut to the opposed ends of the slip end surface allows flush orientation with the support ring surface and a greater flow channel to lead flow into an axial trough that is formed in the slip housing and extends into the ring shape on the slip housing that ultimately contacts the end of each slip. The end dimension of the slips can be as much as 30% wider than the main slip body with some variation tolerated depending on the material thickness available at the undercuts.

The above description is illustrative of the preferred embodiment and many modifications may be made by those skilled in the art without departing from the invention whose scope is to be determined from the literal and equivalent scope of the claims below:

We claim:

1. An anchor assembly for subterranean use in connecting an inner tubular string to a surrounding tubular, comprising:

a slip housing having at least one slip relatively movable with respect to said slip housing in a corresponding at least one slot, said slot having opposed faces in contact with opposed sides of said slip, said faces oriented to move said slip radially into contact with the surrounding tubular as said slip moves axially relatively to said slip housing, said slip being a one piece construction with an outer grip face for contacting the surrounding tubular;

said slot having an end to selectively directly contact said slip after said slip grips the surrounding tubular for support of the inner tubular string to the surrounding tubular and movement of said slot end at least temporarily initially distorting said opposed faces as said slot end continues axial movement into said direct contact with said slip to reorient reaction forces from the surrounding tubular on said slip from principally radial to principally axial;

said slip having an end dimension wider than the width at the remaining length of said slip to increase contact area with slot end.

2. The assembly of claim 1, wherein:

said wider end dimension has opposed undercuts for portions of said end dimension that are wider than said width at the remaining length of said slip.

3. The assembly of claim 2, wherein:

said undercuts are defined by top surfaces that extend radially no further than said slot end upon contact therewith.

4. The assembly of claim 3, wherein:

said slip housing further comprising an axial groove that extends past said slot end.

5. The assembly of claim 4, wherein:

said axial groove having a bottom that extends radially inwardly further than said top surfaces of said undercuts.

6. The assembly of claim 1, wherein:

said slip is relatively movable with respect initially to said slip housing to contact said surrounding tubular.

7. The assembly of claim 6, wherein:

said slip housing is relatively movable with respect to said slip with said slip contacting the surrounding tubular to bring said end of said slot into contact with said slip.

8. The assembly of claim 7, wherein:

said end of said slot is an integrated radial surface on said slip housing.

9. The assembly of claim 7, wherein:

said end of said slot is a discrete ring or segments mounted to said slip housing presenting a radial surface for contact with said slip.

10. The assembly of claim 9, wherein:

said slip comprises wickers that penetrate into the surrounding tubular due to radial movement, said wickers are wider adjacent said end dimension than the remaining length of said slip.

11. The assembly of claim 10, wherein:

said wickers experience shear loading from contact of said radial surface onto said slip.

12. The assembly of claim 11, wherein:

said slips receive a radial reaction force when contacting the surrounding tubular.

13. The assembly of claim 12, wherein:

said slip redirects radial reaction force circumferentially and onto said opposed faces of said slot.

14. The assembly of claim 13, wherein:

said slip yields said opposed faces of said slot.

15. The assembly of claim 14, wherein:

said opposed faces are disposed in intersecting planes.

16. The assembly of claim 15, wherein:

said opposed faces slope away from each other in a radial direction away from an axis of said slip housing.

17. The assembly of claim 1, wherein:

said at least one slip comprises a plurality of circumferentially spaced slips on said slip housing and said at least one slot comprises a plurality of slots with each said slip disposed in a respective said slot.

18. The assembly of claim 17, wherein:

contact of said slip by said end of said slot increases the capacity of said slips by 1,000,000 pounds when compared to prior to said contact.

19. The assembly of claim 1, wherein:

said slip is adapted to be initially movable by a selectively released bias force stored on said slip housing.

20. The assembly of claim 1, wherein:

an initial distance between said slip and said end of said slot is selected to adjust the amount of radial extension before said slip engages the surrounding tubular.

21. The assembly of claim 1, wherein:

said slips are mounted for movement in an uphole or downhole or another direction while extending radially.

* * * * *